United States Patent [19]

Lazich et al.

[11] 4,029,262

[45] June 14, 1977

[54] ANIMAL EXCREMENT DISPOSAL APPARATUS

[76] Inventors: Radovan P. Lazich, 2735 Kroy Way, Sacramento, Calif. 95817; Adolph P. Cascardo, 2233 Mission Ave., Carmichael, Calif. 95608

[22] Filed: Apr. 13, 1976

[21] Appl. No.: 676,546

[52] U.S. Cl. ..... 241/43; 241/46 R; 241/152 A

[51] Int. Cl.[2] ..... B02C 23/36

[58] Field of Search ..... 241/38, 43, 45, 46 R, 241/46 B, 46.08, 46.11, 46.17, 152 R, 152 A, 154, 161, 162

[56] References Cited

UNITED STATES PATENTS

| | | | |
|---|---|---|---|
| 3,053,297 | 9/1962 | Brundler | 241/162 |
| 3,249,310 | 5/1966 | Willems | 241/38 |
| 3,313,332 | 4/1967 | Stephan et al. | 241/152 R |
| 3,695,520 | 10/1972 | Mauro | 241/152 A |
| 3,901,451 | 8/1975 | Lemke et al. | 241/38 |

*Primary Examiner*—Granville Y. Custer, Jr.
*Attorney, Agent, or Firm*—Clarence A. O'Brien; Harvey B. Jacobson

[57] ABSTRACT

An animal excrement disposal apparatus having a conical chamber with a large removable top which will permit easy disposal of solid type animal excrement. A water input means is provided for the conical container. The container is supported upon a small stand which allows portability of the overall device. A waterproof electric motor is provided which is permanently attached to the stand and supports the conical receptacle thereabove. A series of cutter blades are provided on the motor shaft which extends well into the conical receptacle. Beneath the cutter blades is an additional bowl like receptacle having propeller blades mounted therein. This receptacle together with the propeller blades functions to emulsify any solid particals remaining after passage through the receptacle and the cutter blades. A drain is provided to exhaust the emulsified solids and liquid.

8 Claims, 5 Drawing Figures

Fig. 1
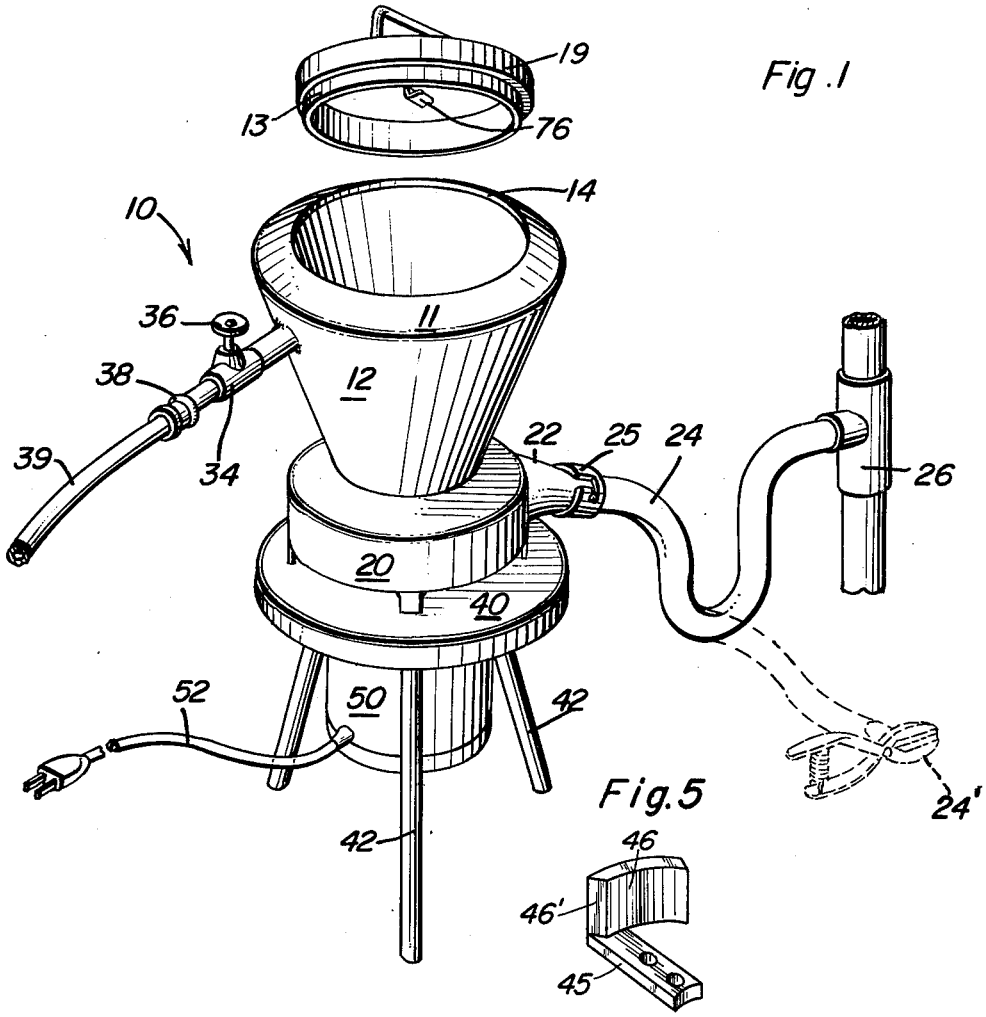
Fig. 5
Fig. 3
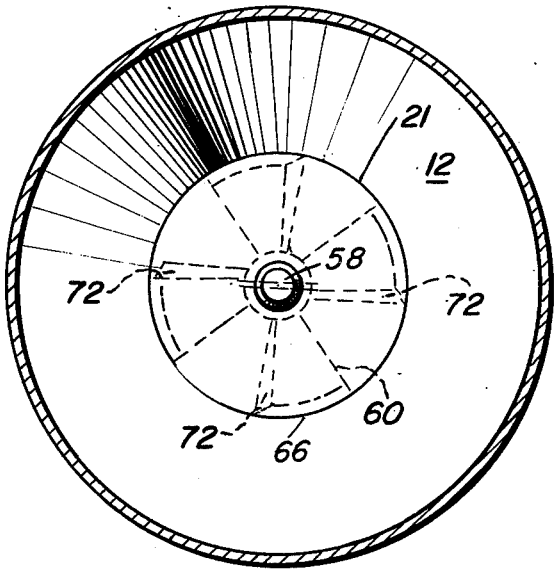
Fig. 4
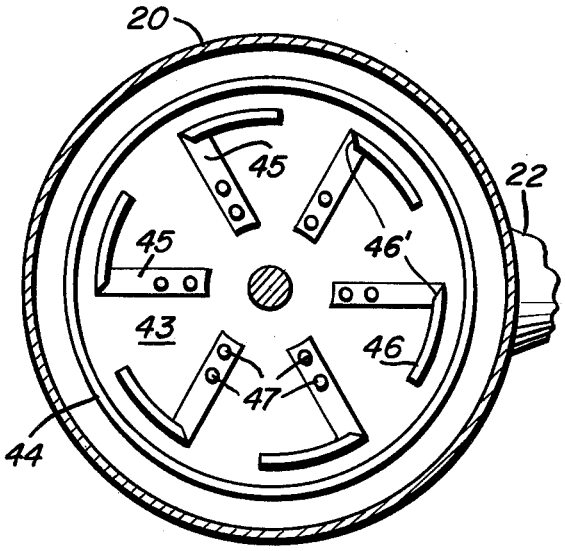

ANIMAL EXCREMENT DISPOSAL APPARATUS

BACKGROUND OF THE INVENTION

This invention relates generally to disposal system apparatus for animal excrement and the like. This apparatus will allow the convenient emulsification and disposal of solid type animal excrement either down a conventional waste system or as liquid fertilizer.

DESCRIPTION OF THE PRIOR ART

A known method of disposal for the solid waste of household pets is to pick up said solid waste and merely dispose of in a convenient trash can, or other disposal type receptacle. Basically this method of disposal merely passes on the problem to someone else, and does not achieve any benefit from the waste material, nor in reality does it eliminate or solve the problem.

Another problem with such type of disposal in garbage cans and the like, is that in most large cities such a manner of disposal is against the city ordinances and a violation of the city, county, or state code. Therefore, if a pet owner uses this manner of disposal a violation of some existing law will most often occur.

Another problem with such a manner of disposal is that no beneficial results are achieved and the waste material, which in most cases does contain beneficial nutrients is completely lost.

A number of known prior art devices exist for pulverizing or grinding up food and like matters such as the well known common household blender type equipment for vegetables and the like, as well as the conventional garbage disposal type systems which are normally installed in the sinks of most modern homes. However, none of these devices are specifically designed for pet excrement of the solid type, nor are they specifically arranged to effect the purpose of this invention. They also do not offer the ready portability or convenience of a system or apparatus which has been specifically designed with this purpose in mind such as that disclosed herein.

SUMMARY OF THE INVENTION

An object of the present invention is to provide a portable pet animal excrement disposal apparatus. One which will permit the homeowner to easily and conveniently breakup and emulsify the solid pet excrement before either flushing away through the home disposal waste system, or preferably before spreading over the lawn and garden in order to receive the benefit of the nutrients contained therein.

Another object of the present invention is to provide an animal excrement disposal apparatus which is conveniently portable, supported on an appropriate height stand to permit ready and easy use thereof, and one which will allow the user from coming into direct physical contact with the animal excrement.

A further object of this invention is to provide a disposal apparatus having all the electrical components thereof waterproof construction to eliminate any shock or fire hazard from said apparatus.

A still further object of this invention is to provide an animal waste disposal apparatus having a double set of blade structures for cutting up the solid waste and emulsifying said solid waste both operated from a single drive unit.

Another still further object of this invention is to provide a specially shaped receptacle container unit for receiving solid waste material and also receiving clean water input together with cutting and breakup mechanism for completely shredding and emulsifying the solid materials into an emulsified liquid for easy disposal or use thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the overall animal excrement disposal apparatus of this invention.

FIG. 3 is a cross-sectional view taken generally along line 3 — 3 of FIG. 2.

FIG. 4 is a cross-sectional view taken generally along line 4 — 4 of FIG. 2.

FIG. 5 is a perspective view of a propeller blade per se as shown in the view of FIG. 4.

DESCRIPTION OF THE PREFERRED EMBODIMENT

Figure 2:
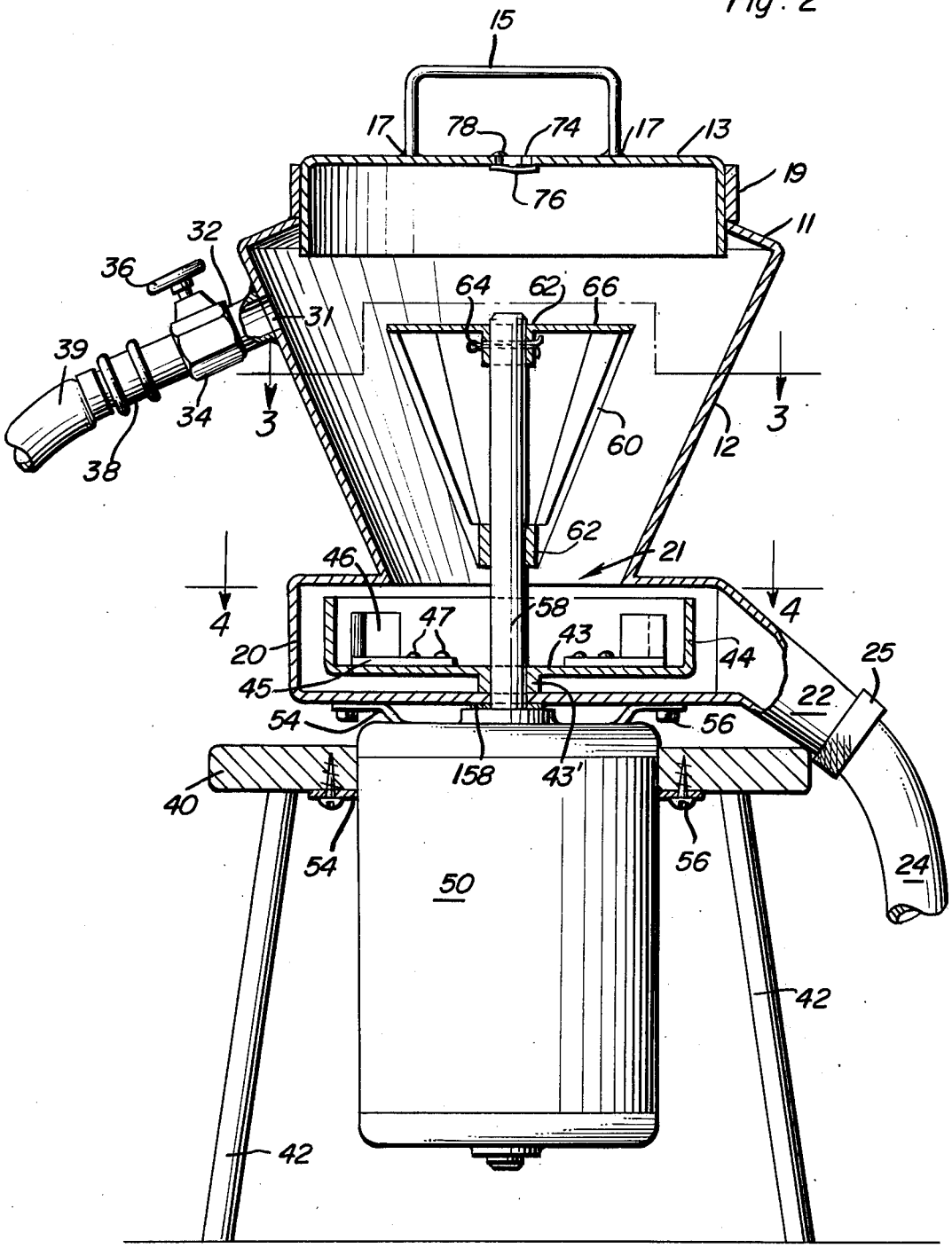
FIG. 2 is a view in elevation, partly in cross-section, taken generally along the center line in a vertical plane of the apparatus shown in FIG. 1.

Referring to FIG. 1 of the drawings, reference numeral 10 indicates in general the animal excrement disposal apparatus of this invention. A large collar 11 is shown mounted on the top of a conical or funnel shaped receptacle 12. A lid 13 is mountable within the opening 14 of the collar at the top of said receptacle for closure thereof.

Looking at FIG. 2, one can see how the lid 13 securely covers and encloses the top opening 14 of the receptacle. A band 19 is secured by any suitable fastening means to the lid 13 which is basically a dish-like or a can-like cover. This cover as well as the receptacle, etc. may be of metal, plastic or any other suitable or convenient material. If made of metal then the band 19 may be appropriately fastened by press fitting thereover or spot welded thereto. If made of plastic one of the new plastic adhering glues, such as the epoxies may be used. A handle 15 is also provided on the top of the cover, suitably fastened by welding or glue, or the like at points 17.

The container 12 tapers down in funnel shape to the central opening 21 at the bottom portion thereof. Opening 21 connects with the main support and body structure 20 which is an enclosed container having an exhaust or disposal extension 22 at one side thereof. The disposal extension 22 normally will be connected to a flexible tube or hose 24 by means of a quick coupling number 25. As shown in FIG. 1, the hose 24 may be coupled to a T connection 26 of a household waste system. However, often it is preferred to use the emulsified waste liquid by spreading same over the lawn or garden of the household. For such use an optional hose clamp, as 24', may be provided to shut off the end of hose 24 rather than connecting to the T connection 26 as shown. Obviously, when the apparatus is being used as a source of liquid fertilizer, the hose clamp will remain closed until the entire apparatus, which is fairly light and extremely portable, is carried to the place of desired disposal and then the hose clamp opened.

A point of clear water input is also provided by the opening 31 at the top of the conical receptacle, opening 31 is connected to an inlet 32 having a valve 34 with valve knob 36 thereon. A normal hose type coupling 38 is connected to a water hose or line 39 which is connected to the household water system. Obviously the device may be set up outside one's house and hooked up to the lawn hose and in such case the water supply can remain hooked up semi-permanently, and when using a hose clamp on disposal hose 24 the unit will be convenient and ready for daily use. If used within one's home, then the hose coupling 38 can be unhooked after use in order to conveniently move the apparatus outside for disposal or spredding of the effluent over the lawn and garden. Or the apparatus may be semi-permanently installed in the house or other building, as best seen in FIG. 1, and as already described above.

A support stand 40 of wood or plastic type material having at least three support legs 42, also is provided. Mounted from the bottom of said stand by attaching brackets 54 is a waterproof electric motor 50. This electric motor has a conventional electric cord 52 and is preferably of waterproof construction to eliminate any possibility of shock or fire hazard as the device is being used with water. Screws 56 are shown in FIG. 2 as holding the support brackets for the motor to the bottom surface of the support structure 40. Three or more brackets 154 are also mounted on the drive shaft side of the electric motor for supporting the housing structure 20 by appropriate bolts 156. The motor drive shaft 58 extends through an appropriate aperture within the bottom wall of housing 20 and into said housing 20, and is of sufficient length to extend a good distance into the conical receptacle 21, as best seen in FIG. 2. A gasket means 158 is provided adjacent the aperture through housing 20 to prevent any leaks therefrom. Mounted within the housing 20 and driven and supported by the drive shaft 58 is a dish-like receptacle 43. This dish-like receptacle 43 has an upward extending flange or edge 44 completely around the circumference thereof. The hub portion 43′ is appropriately splined or keyed, by means not shown to the drive shaft 58 for a positive rotation therewith.

Mounted within the receptacle 43, 44 are propeller blades 45, 46. These blades are approximately riveted or otherwise fastened by means 47 to the inside of said receptacle, as best seen in FIG. 2 and 4. The upwardly extending flange portions 46 of the blades 45 define, as best seen in FIG. 4, part of the circumference of a circle. It has been discovered that this shpae is especially effective for emulsifying the partially shredded and broken up particles of excrement. FIG. 5 shows a single blade per se having a knife-like edge 46′ on the leading edge of blade 46.

Looking at FIG. 2, the upper end of the drive shaft 58 supports cutter blades 60 which have central hub structure 62 which centers and attaches the cutter blades to the drive shaft. A cotter pin type key 64 is shown, but splined or key and slot type drive connections may also be used.

Looking at FIG. 3, the cutting edges 72 on the blades 60 can best be seen, the top centering hub 62 is mounted on a disc 66 for supporting the upper ends of the blades 60 in a conical or tapered configuration which complements the taper of the container 12. This shape has been found to produce very efficient results.

Normally when in use, animal excrement will be placed into the receptacle 12 after the cover 13 has been removed therefrom. Then the valve 34, 36 is opened to permit water into the receptacle and the electric motor energized by plugging the cable 52 into a convenient electrical outlet. Obviously a switch may be included in the line 52 for convenience if desired. At the top center portion of the cover 13 a flapper valve air input opening 74 is shown. This opening 74 permits the cover to be placed upon the receptacle after the solid excrement is placed therein and before the water is turned on. Since the cover is practically air tight, unless some means of allowing air into the receptacle is provided the system will not function properly with the top closed. Of course, the top may be left off and the system will operate fine, but with the high speed rotation of the cutter blade 60, etc. this may be somewhat messy. Therefore, the flutter valve 76 with the rivet 78 or other fastening means is normally provided to permit air into this apparatus but prevent any spray or splattering from coming out the air opening 74.

As can be envisioned from the above description, the apparatus herein disclosed offers a new and unique manner of disposing of household pet type solid excrement. It is convenient and safe to use, inexpensive to operate, and has some very desirable side benefits of allowing the emulsified waste to be used as fertilizer.

What is claimed as new is as follows:

1. An animal excrement disposal apparatus comprising; portable means for emulsifying and holding animal excrement so it may be used for liquid fertilizer including a primary receptacle of conical configuration having a large opening at the top thereof, a closure means for said top opening, means rotatably within the receptacle for breaking up solid excrement, means for admitting liquid to the receptacle, further means for exhausting the liquid fertilizer from the receptacle, the means rotatably mounted within the receptacle for breaking up solid excrement includes a motor attached to the bottom of the receptacle, a drive shaft extending from the motor into the receptacle, means on the drive shaft for cutting the excrement into pieces, additional means associated with the drive shaft for emulsifying the excrement, and the means on the drive shaft for cutting the excrement includes a conically shaped rotor formed of a plurality of cutter blades having an overall shape which complements the interior shape of the primary receptacle.

2. The structure set forth in claim 1, wherein the closure means includes an air tight cover for the opening, and an air admitting valve mounted in said cover to permit air to enter the closed receptacle when the apparatus is in operation.

3. The structure set forth in claim 2, together with a support base for the motor and attached receptacles, and at least three legs supporting the support base in order to hold same a short distance above a floor or other support surface for convenient use of the apparatus.

4. The structure as set forth in claim 3, including an enclosed housing of water tight construction between the bottom of the primary conical receptacle and the motor, an outlet provided in the second housing for discharge of the emulsified excrement and a flexible hose is removably connected to said outlet.

5. The structure set forth in claim 4, together with a dish-like container and flange blades mounted within the dish-like container, the container being drivenly mounted on the drive shaft of the motor within the second housing.

6. The structure set forth in claim 1, wherein the means for admitting liquid to the receptacle includes a water inlet valve on the receptacle adjacent the top thereof for connection to an ordinary garden hose, and the means for exhausting the liquid fertilizer includes an exhaust outlet adjacent the bottom thereof with a flexible hose having a hose clamp thereon removably connected thereto.

7. The structure set forth in claim 6, together with a support base connected to the motor for supporting same, the support base having at least three legs depending therefrom.

8. The structure set forth in claim 7, wherein the additional means associated with the drive shaft for emulsifying the excrement includes a secondary enclosed housing arranged between the lower portion of the primary receptacle and the motor and connected to the exhaust outlet, and an additional means contained within the enclosed housing and mounted on the drive shaft of the motor for further breaking up of and emulsifying of solid excrement particles into liquid fertilizer.

* * * * *